United States Patent [19]

Kendall

[11] Patent Number: 4,884,641

[45] Date of Patent: Dec. 5, 1989

[54] BACKHOE HAMMER

[75] Inventor: Steven S. Kendall, Davison, Mich.

[73] Assignee: Genesee Polymers Corporation, Flint, Mich.

[21] Appl. No.: 814,875

[22] Filed: Dec. 30, 1985

[51] Int. Cl.[4] ..... B23B 45/16

[52] U.S. Cl. ..... 173/94; 414/724; 37/DIG. 12; 173/46

[58] Field of Search ..... 173/46, 94; 37/103, 37/117.5, DIG. 9, DIG. 12, DIG. 18; 414/724, 912; 299/67

[56] References Cited

U.S. PATENT DOCUMENTS

| | | | |
|---|---|---|---|
| 1,731,985 | 10/1929 | Reaney | 173/46 X |
| 3,915,501 | 10/1975 | Cobb et al. | 173/46 X |
| 3,990,595 | 11/1976 | Cobb et al. | 173/46 X |
| 4,602,821 | 7/1986 | Schaeff | 173/46 X |

*Primary Examiner*—Douglas D. Watts
*Assistant Examiner*—Willmon Fridie, Jr.
*Attorney, Agent, or Firm*—Reising, Ethington, Barnard, Perry & Milton

[57] ABSTRACT

A backhoe assembly (10) comprises a boom (12) for pivotal attachment to a machine (11). A bucket (14) is pivotally supported by the boom (12) for rotation about a support axis (16). A hydraulic cylinder (34) having a piston rod (36) raises and lowers the boom (12) and rotates the bucket (14) about the support axis (16) between an open and closed position. The assembly (10) is characterized by a hammer (20) supported in a cantilevered fashion for pivotal movement about the support axis (16) by the bucket (14) between a cocked position on a cocked side of an over-center position and a released free-fall position on the other side of the over-center position.

12 Claims, 4 Drawing Sheets

BACKHOE HAMMER

TECHNICAL FIELD

The subject invention relates to a hammer for crushing stone in conjunction with earth-moving equipment and, particularly, a hammer utilized with a backhoe.

BACKGROUND ART

Wrecking machines for demolition have been used extensively for delivering forces to wreck or crush buildings and stone. This has been accomplished in the past by rigidly securing a boom with a tool head or pick to a bulldozer blade or a backhoe bucket. The force of the tool is delivered by raising and lowering the blade or bucket to act as a hammer similar to the mechanical movement of a human hammering a nail.

The problem with such wrecking machines is that large demolition impacts cannot be obtained since the momentum with which the wrecking machine delivers the force is controlled by the rate at which the tool head is lowered. Also, rigidly attaching the boom of the tool head to the blade or bucket will produce high concentrated stresses at the location at which the boom of the tool head is secured to the bucket, due to the impact force being transmitted from the contacting surface Further, the momentum of the impacting force will from cycle to cycle. Finally, the height at which the tool head is raised and lowered will also vary from cycle to cycle.

STATEMENT OF INVENTION AND ADVANTAGES

A backhoe hammer assembly comprises a boom means for pivotal attachment to a machine. A bucket is pivotally supported by the boom means for rotation about a support axis. The assembly includes actuation means for raising and lowering the boom means and for rotating the bucket about the support axis between open and closed positions. The assembly includes a hammer means supported in a cantilevered fashion for pivotal movement about the support axis by the bucket between a cocked position on a cocked side of an over-center position and a released free-fall position on the other side of the over-center position.

Accordingly, the subject invention can be utilized with existing backhoes. Also, large impact forces may be obtained since the hammer falls from its uppermost elevated position. Further, the momentum of the impact is uniform for each cycle since the hammer falls from its own weight due to gravity from the same elevated position. Finally, stresses are not induced on the bucket during contact since the hammer falls independently of the bucket and is not rigidly connected to the bucket.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
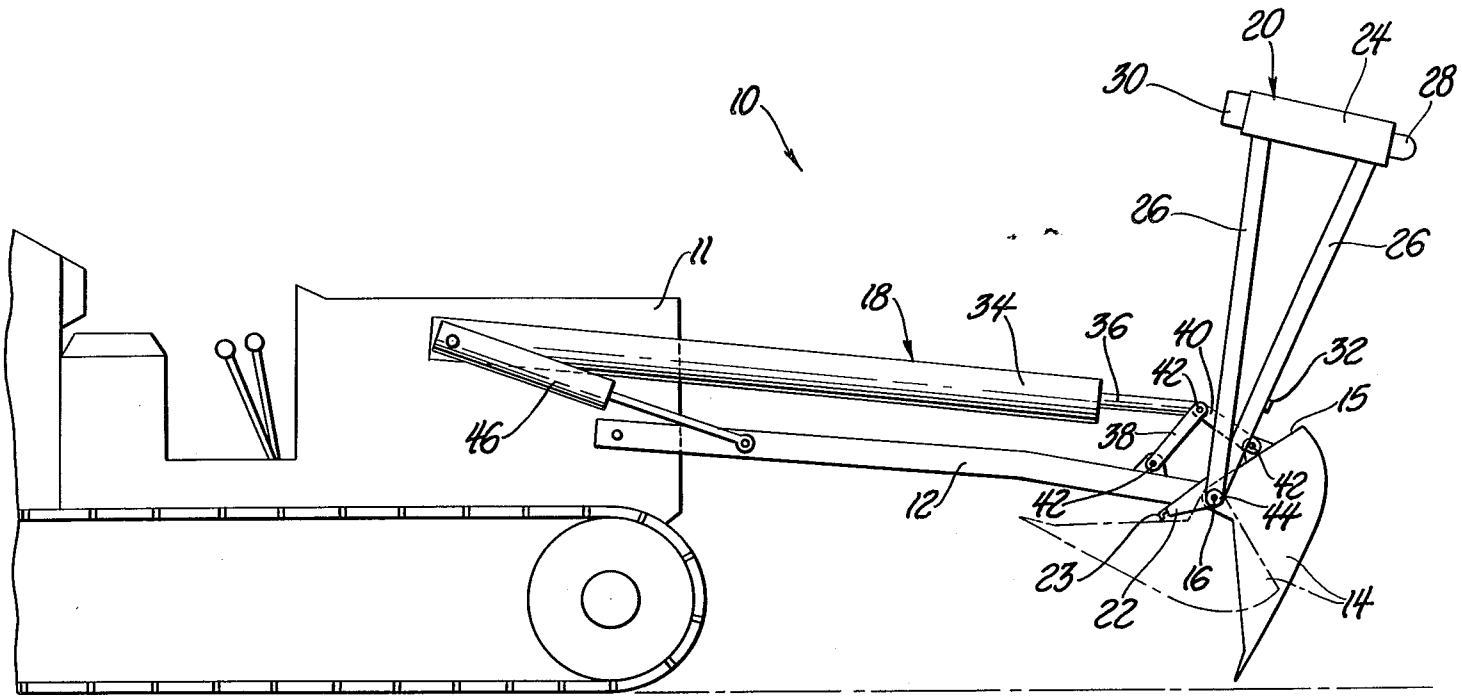
FIG. 1 is a profile side view of the subject invention utilized on a backhoe.

A bulldozer or backhoe assembly utilizing the subject invention is generally shown at 10 in FIG. 1 and totally in FIGS. 2–5. The assembly 10 includes a boom means or backhoe arm 12 which of a type well-known in the art for pivotal attachment to a machine such as a backhoe. A blade or bucket is pivotally supported by the boom means 12 and connected to the boom means 12 by a fastening means 44 for rotation about a support axis 16. The fastening means 44 comprises a hinge pin 44 for pivotally securing the bucket 14 to the boom means 12. An operative means 18 rotatably extends and retracts the bucket 14 between open and closed positions about the support axis 16. The operative means 18 comprises a first hydraulic cylinder 34, or the like, having a piston rod 36 for rotatably extending and retracting the bucket 14 about the support axis 16. In other words, as the piston rod 36 retracts or extends from the first hydraulic cylinder 34, the bucket 14 rotates upwardly or downwardly about the support axis 16, respectively. A second hydraulic cylinder 46 interconnecting the boom means 12 and machine 11 is used for raising and lowering the boom means 12. A first linkage 38 interconnects the boom 12 and the piston arm 36 of the hydraulic cylinder 34. A second linkage 40 interconnects the bucket 14 and the piston rod 36 of the hydraulic cylinder 34. Fasteners 42 pivotally connect the first linkage 38 and second linkage 40 to the piston arm 36 and the boom 12 and bucket 14, respectively. All of the above is of a type well-known in the art for raising and lower the bucket of a backhoe and other well-known assemblies may be used.

In accordance with the hammer means of the subject invention, generally indicated at 20, the hammer or the like is used for breaking up masonry and stone. The hammer means 20 is pivotally connected by the fastening means 44 to the boom 12 and is supported in a cantilevered fashion for pivotal movement about the support axis 16 by the bucket 14. The hammer means 20 comprises a hammer head 24, and at least one strut 26 connected to the hammer head 28 and the support axis 16 for movement of the hammer head 24 in an arc about the support axis 16. Preferably, a plurality of struts 26 are connected to the hammer head 24. The free ends of the struts 26 are removably connected to the fastening means 44. In other words, the struts 26 interconnect the hammer head 24 to the hinge pin 44 so that the hammer means 20 can be removed from the assembly 10 when desired. Further, the hammer head 24 is allowed to rotate about the hinge pin 44 by the struts 26. The hammer head 24 includes a contact or hammer portion 28 on the forward end of the hammer head 24 with respect to the hinge pin 44 for contacting a surface.

The assembly 10 includes pad means 30 for supporting the hammer means 20 on the boom means 12 in a cocked position The hammer head 24 includes the padded portion or means 30 on the rearward or opposite end of the hammer head 24 with respect to the hammer portion 28. The padded portion 30 is made from a shock-absorbent material. The strut 26 include a cushion or absorption pad 32 attached to the forward side of the strut 26 for cushioning the contact between the strut 26 and the bucket 14. The absorption pad 32 comprises a shock-absorbable material. The assembly 10 further includes a trip or reaction means 22 to react between the bucket 14 and the hammer means 20 for moving the hammer means 20 from a ground impact position through the over-center position for disposition in the cocked position in response to rotational movement of the bucket 14 toward the open position The reaction means also moves the hammer means 20 from the cocked position through the over-center position for free-fall movement in response to rotational movement of the bucket 14 toward the closed position. The reaction means 22 comprises an extension 23 projecting from the bucket 14 for engaging one side of the strut 26 of the boom means 12 for movement from the cocked position. The reaction means 22 further includes an interface 15 between the bucket 14 and the strut 26 for contact between the other side of the strut 26 and the bucket 14 for movement of the hammer means 20 toward the cocked position by the bucket 14.

Figure 2:
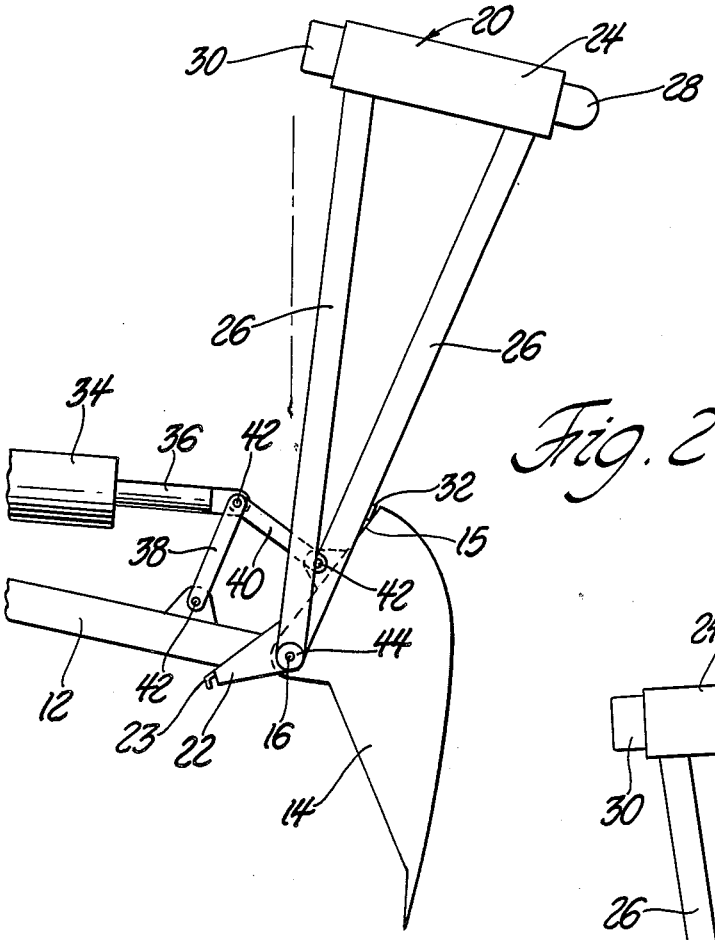
FIG. 2 is a profile view of the subject invention in an elevated position slightly forward of center.
Figure 3:
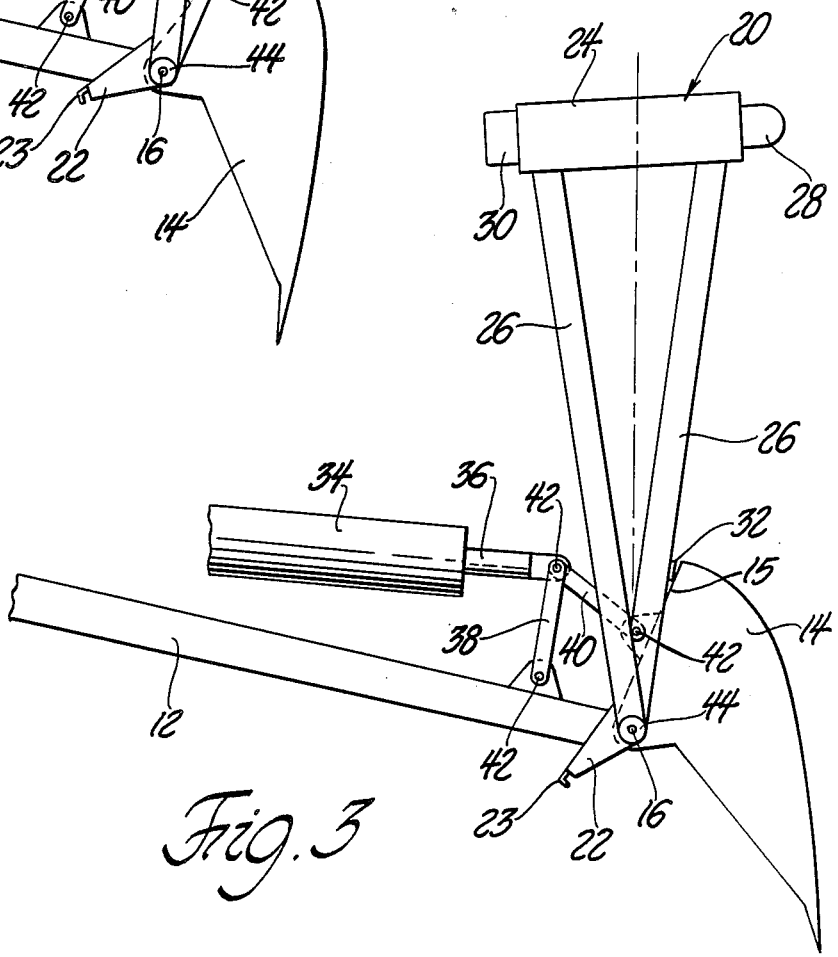
FIG. 3 is a profile view of the subject invention in an elevated position with the center of gravity of the subject invention offset rearwardly from center.
Figure 4:
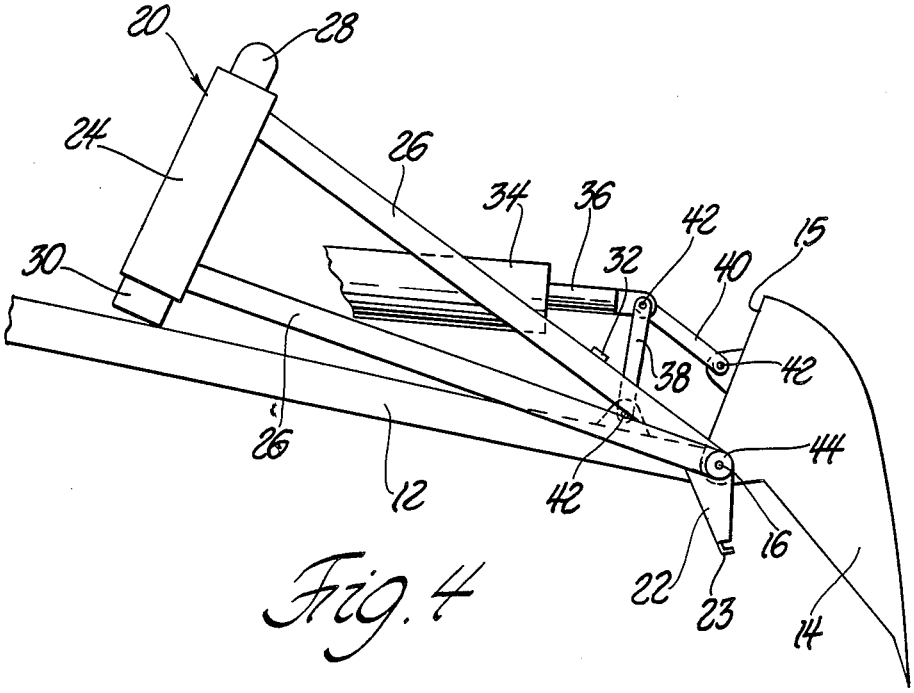
FIG. 4 is a profile view of the subject invention in a rest position.

In operation, the piston arm 36 of the hydraulic cylinder 34 is retracted as illustrated in FIG. 2, rotating the bucket 14 upwardly and rearwardly about the support axis 16 via the first 38 and second 40 linkages. As the bucket 14 rotates rearwardly, the bucket 14 contacts the strut 26 at the absorption pad 32, lifting the hammer means 20. The bucket 14 continues to lift the hammer means 20 until the center of gravity of the hammer means 20 passes vertically over the support axis 16 in an over-center position as illustrated in FIG. 3. When the hammer means 20 reaches this over-center elevated position, the means 20 moves rearwardly free-falling from the weight of the hammer means 20 and falls onto the boom 12 in a cocked position as illustrated in FIG. 4. The rest pad 30 absorbs the shock of this fall.

Figure 5:
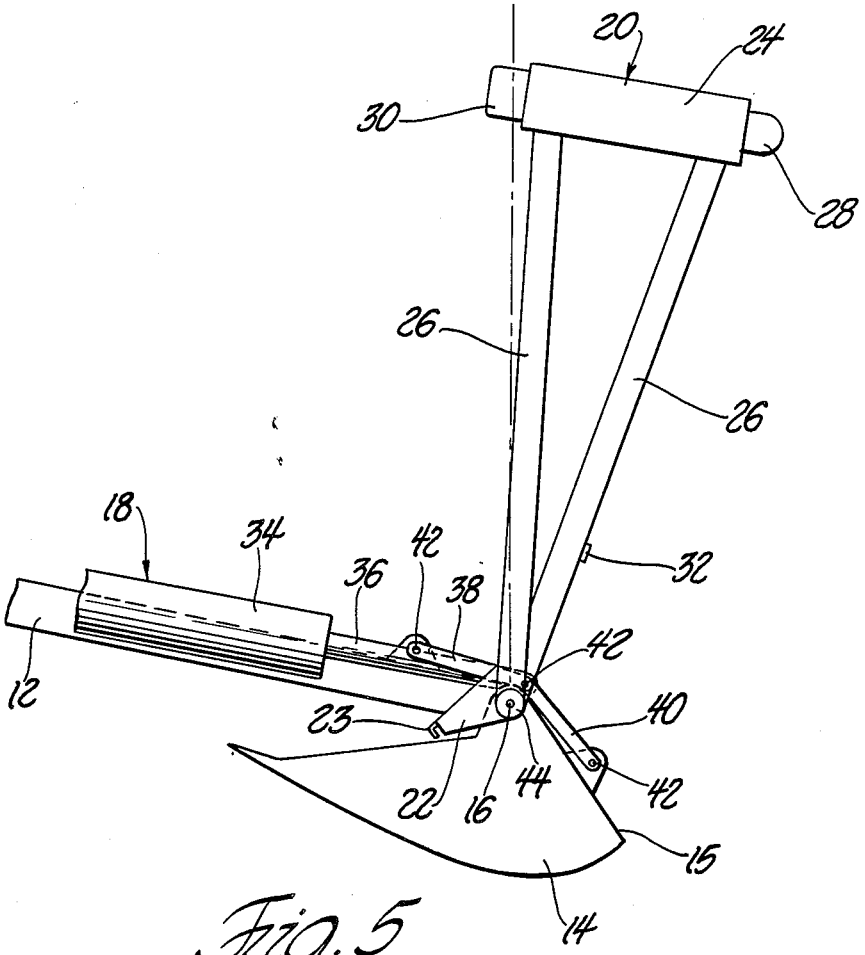
FIG. 5 is a profile view of the subject invention in forward motion.

The bucket 14 is then extended forward by the piston arm 36 of the hydraulic cylinder 34 into contact with the extension 23 of the reaction means 22, moving the hammer means 20 forward to an over-center elevated position on the other side of the cocked position as illustrated in FIG. 5, releasing the hammer means 20 to move forward, free-falling by the weight of the hammer means 20. In other words, as the bucket 14 continues to extend or move downwardly, the hammer means 20 is operatively moved forward until the center of gravity of the hammer means 20 again passes vertically over the support axis 16. At this point, the hammer means 20 will free fall, due to the weight of the hammer means 20, until it strikes the ground or a surface with the contact portion 28. The process is then repeated.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended wherein reference numerals are merely for convenience and are not be be in any way limiting, the invention may be practiced otherwise than as specifically described.

What is claimed is:

1. A backhoe assembly (10) comprising; a boom means (12) for pivotal attachment to a machine (11), a bucket (14) pivotally supported by said boom means (12) for rotation about a support axis (16), actuation means (18) for raising and lowering said boom means (12) and for rotating said bucket (14) about said support axis (16) between open and closed positions, characterized by hammer means (20) supported in a cantilevered fashion for pivotal movement about said support axis (16) by said bucket (14) between a cocked position on a cocked side of an over-center position and a released free-fall position on the other side of the over-center position.

2. A backhoe assembly (10) comprising; a boom means (12) for pivotal attachment to a machine (11), a bucket (14) pivotally supported by said boom means (12) for rotation about a support axis (16), actuation means (19) for raising and lowering said boom means (12) and for rotating said bucket (14) about said support axis (16) between open and closed positions, characterized by hammer means (20) supported in a cantilevered fashion for pivotal movement about said support axis (16) by said bucket (14) between a cocked position on a cocked side of an over-center position and a released free-fall position on the other side of the over-center position, and including reaction means (22) to react between said bucket (14) and said hammer means (20) for moving said hammer means (20) from a ground impact position through said over-center position for disposition in said cocked position in response to rotational movement of said bucket (14) toward said open position and for moving said hammer means (20) from said cocked position through said over-center position for free-fall movement in response to rotational movement of said bucket (14) toward said closed position.

3. An assembly as set forth in claim 2 further characterized by including pad means (30) for supporting said hammer means (20) on said boom means (12) in said cocked position.

4. An assembly as set forth in claim 3 further characterized by said hammer means (20) including a hammer head (24), and at least one strut (26) connecting said hammer head (24) to said support axis (16) for movement of said hammer head (24) in an arc about said support axis (16).

5. An assembly as set forth in claim 4 further characterized by said reaction means (22) including an extension (23) projecting from said bucket (14) for engaging one side of said strut (26) of said boom means (12) for movement from said cocked position.

6. An assembly as set forth in claim 5 further characterized by said reaction means (22) being further defined by an interface (15) between said bucket (14) and said strut (26) for contact between the other side of said strut (26) and said bucket (14) for movement of said hammer means (20) toward said cocked position by said bucket (14).

7. An assembly as set forth in claim 6 wherein said hammer head (24) has opposite ends with said pad means (30) extending from one end and a hammer portion (28) extending from the other end.

8. An assembly as set forth in claim 7 further characterized by said pad means (30) comprising a shock-absorbable material.

9. An assembly as set forth in claim 7 further characterized by including an absorption pad (32) attached to the forward side of said strut (26) for cushioning the contact between said strut (26) and said bucket (14).

10. An assembly as set forth in claim 9 further characterized by said absorption pad (32) comprising a shock-absorbable material.

11. An assembly as set forth in claim 7 further characterized by said actuation means (18) including a hydraulic cylinder (34) having a piston rod (36) for rotatably extending and retracting said bucket (14) about said support axis (16).

12. An assembly as set forth in claim 11 further including fastening means (44) comprising a hinge pin (44) for allowing rotation between said bucket (14) and said boom means (12).

* * * * *